United States Patent [19]

Webber

[11] 4,008,701

[45] Feb. 22, 1977

[54] MAGNETIC CIRCUIT APPARATUS FOR AN ELECTRONIC IGNITION SYSTEM OF A COMBUSTION ENGINE

[75] Inventor: Hugh C. Webber, Detroit, Mich.

[73] Assignee: Essex International, Inc., Fort Wayne, Ind.

[22] Filed: Dec. 31, 1975

[21] Appl. No.: 645,801

[52] U.S. Cl. ..... 123/148 E

[51] Int. Cl.[2] ..... F02P 1/00

[58] Field of Search ..... 123/148 E

[56] References Cited

UNITED STATES PATENTS

| | | | |
|---|---|---|---|
| 3,822,686 | 7/1974 | Gallo | 123/148 E |
| 3,875,920 | 4/1975 | Williams | 123/148 E |

*Primary Examiner*—Robert G. Nilson

*Attorney, Agent, or Firm*—Learman & McCulloch

[57] ABSTRACT

Magnetic circuit apparatus for use in an electronic ignition system of a combustion engine having one or more spark ignition devices comprises a magnetically permeable frame on which is supported a field magnet and a Hall Effect pulse generator in spaced apart relation such that the field magnet and frame provide a magnetic flux path to which the pulse generator periodically is exposed to produce successive pulses in timed relation to the speed of operation of the engine. A bias magnet confronts the pulse generator at that side of the latter which is opposite to the field magnet and has a polarity opposite that of the field magnet. The flux density of the bias magnet is substantially less than that of the field magnet.

15 Claims, 5 Drawing Figures

MAGNETIC CIRCUIT APPARATUS FOR AN ELECTRONIC IGNITION SYSTEM OF A COMBUSTION ENGINE

In lieu of the conventional cam operated breaker point ignition systems of combustion engines it is fairly common to utilize an electronic ignition system of the kind in which a magnetically operated pulse generator or Hall Effect element is provided to produce a series of electrical pulses to the fuel igniting devices of the engine. Typical of such electronic ignition systems are those disclosed in U.S. Pat. Nos. 2,924,633; 3,195,043; 3,203,412; 3,241,538; 3,297,009; 3,373,729; and 3,587,549.

In all electronic ignition systems utilizing magnetic pulse generators the amplitude of the pulses generated by such generators is dependent upon the rate of change of the magnetic flux to which the generator is subjected. At low engine speeds, such as those obtained during cranking, the rate of change of the magnetic flux is low, thereby producing low amplitude ignition pulses and necessitating the provision of means to effect amplification of such pulses. At higher engine speeds, care must be taken not only to subject the pulse generator to differential flux densities sufficient to produce pulses of adequate amplitude, but also to maintain proper timing as to the operation of the pulse generator. Timing of the operation of the generator is controlled by exposing the generator to a magnetic field and subsequently shunting or reducing the field, thereby producing a pulse. Hall Effect elements invariably differ one from another insofar as their pulse generating capabilities are concerned. That is, the points on the leading and trailing edges of the pulse between which one Hall element is conductive rarely if ever are the same as those of another Hall element. Timing of the operation of the pulse generator, however, is critical to efficient operation of the ignition system and of the engine of which it is a part.

The foregoing problems associated with pulse amplitude and timing are directly related to flux density That is, there must be sufficient flux density to energize the pulse generator and the flux density must be sufficiently reduced when the generator is shunted to deenergize the generator. It is not sufficient to overcome these problems simply by increasing the strength of the magnetic field, however, inasmuch as there then may be sufficient residual flux when the magnetic field is shunted either to prevent the Hall element's being deenergized or to distort the points of the pulse at which the generator is deenergized.

The principal object of this invention is to provide a magnetic circuit for an electric ignition system utilizing a Hall Effect pulse generator and wherein ample magnetic flux density is provided to assure energization of the generator while at the same time providing for a sufficient flux differential when the magnetic field is shunted to assure deenergization of the generator at a desired point on the trailing edge of the pulse.

The foregoing objective is achieved by the provision of a magnetic frame establishing a flux path and a primary, relatively strong permanent magnet spaced from the Hall Effect pulse generator by a gap through which spaced apart magnetic plates or fingers may pass so as periodically to shunt the magnetic field. A relatively weak, bias permanent magnet also confronts the generator, but on the opposite side of the gap, and the bias magnet has a polarity which opposes the primary magnet. The strength of the bias magnet is selected so that it has little effect on the pulse generator when the latter is exposed to the flux of the primary magnet, but it diminishes the residual flux due to the primary magnet when the flux path is shunted, thereby providing ample flux differential.

Other objects and advantages of the invention will be pointed out specifically or will become apparent from the following description when it is considered in conjunction with the appended claims and the accompanying drawings wherein:

Figure 1:
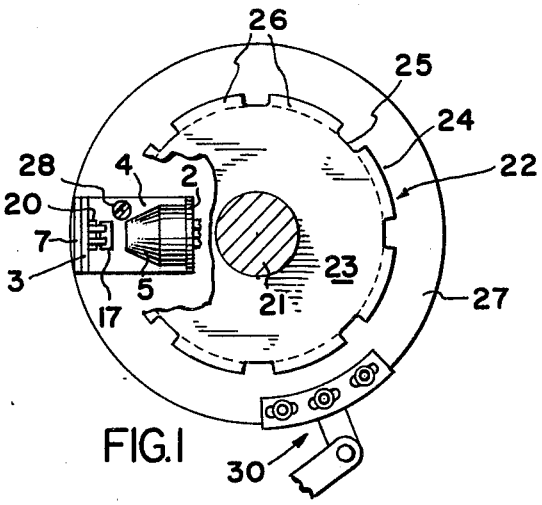
FIG. 1 is a fragmentary plan view of apparatus constructed according to the invention and mounted in operative relation with an engine driven, magnetic rotor.
Figure 2:
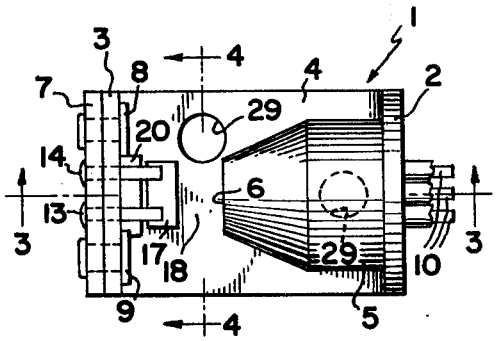
FIG. 2 is an enlarged plan view of the apparatus.
Figure 3:
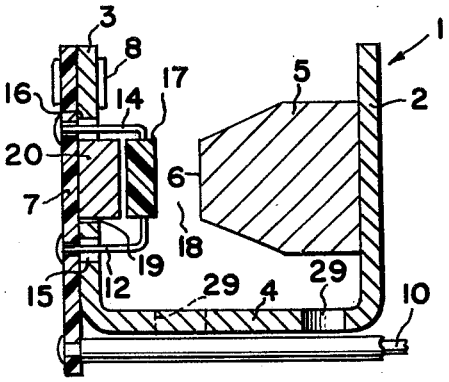
FIG. 3 is a sectional view taken on the line 3—3 of FIG. 2.
Figure 4:
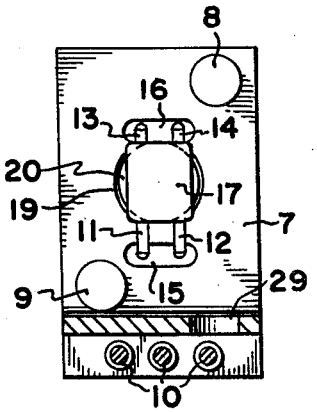
FIG. 4 is a sectional view taken on the line 4—4 of FIG. 2.
Figure 5:
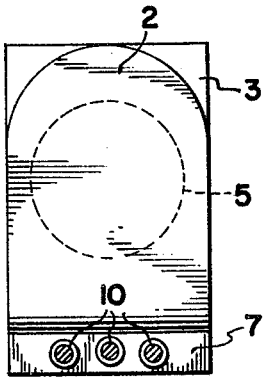
FIG. 5 is an end elevational view.

Apparatus constructed in accordance with the disclosed embodiment of the invention comprises a one-piece, U-shaped frame 1 composed of magnetically permeable metal and having a pair of parallel legs 2 and 3 joined together at corresponding ends by a web 4. Secured to the leg 2 is a permanent primary or field magnet 5 which tapers toward a pole face 6. The tapered configuration of the magnet concentrates the flux at the pole face and the frame and magnet form a magnetic flux path having a single air gap.

A printed circuit board 7 is fixed to the leg 3 of the frame by means of rivets 8 and 9. The printed circuit board carries at its outer face electrical conductors which are electrically connected to insulated conductive leads 10 in a conventional manner. The conductors of the circuit board 7 also are connected to conductive members 11, 12, 13, and 14 which extend through openings 15 and 16 formed in the frame leg 3 and provide electrical connections to and support for a known Hall Effect semiconductor element such as that manufactured by Microswitch Division of Honeywell, Inc., and designated part No. 613-SS. The element 17 confronts the pole face 6 of the primary magnet 5 but is spaced therefrom by a gap 18. The element 17 also is spaced from the frame leg 3 and the latter is provided with an opening 19 which is closed at the outer side of the leg 3 by the circuit board 7.

Fitted into the space between the printed circuit board 7 and the element 17 is a secondary, bias magnet 20 which occupies the opening 19 and is magnetically retained therein. The magnets 5 and 20 are so arranged that their polarities oppose one another. Confronting faces of the magnets 5 and 20 are substantially equal in area, but the magnetic strength of the bias magnet 20 is substantially less than the magnetic strength of the primary magnet 5.

Apparatus constructed according to the invention is adapted for use in the ignition system of a combustion engine having a driven shaft 21 coupled to a rotor 22 formed of magnetically permeable metal. The rotor 22 preferably is cup-shaped having a flat crown 23 and a depending skirt 24 provided with uniformly spaced slots 25 which divide the skirt into a plurality of uniform fingers 26, there being one such finger for each spark plug or other fuel igniting device of the engine.

The frame 1 is mounted on a plate 27 by means of screws 28, which pass through openings 29 in the frame web 4. The plate 27 is similar to the plate on which are mounted the contact points of a breaker point assembly of previously conventional automotive ignition systems and is adjustable angularly by means of a known adjusting mechanism 30. The frame 1 is so mounted on the plate 27 that rotation of the rotor 22 causes the magnetic fingers 26 to pass in succession through the gap 18 between the pole face 6 of the magnet 5 and the Hall Effect element 17.

When the apparatus is mounted in the manner shown in FIG. 1, operation of the vehicle engine, during either cranking or running condition, will effect rotation of the shaft 21 and of the rotor 22. Each time that a slot 25 between adjacent fingers 26 passes through the gap 18, the element 17 will be subjected to the magnetic flux of the primary magnet 5. Each time that one of the magnetically permeable fingers 26 occupies the gap 18, however, the Hall element 17 will be shielded from the magnetic flux of the primary magnet. That is, the magnetic field will be shunted. The successive exposure to and shielding from the magnetic flux causes the Hall element successively to be energized and deenergized, thereby enabling the Hall element to generate successive electrical pulses which are fed via the conductors 10 to the engine's ignition system in the conventional manner.

The primary magnet 5 is chosen deliberately so that its flux density is more than ample to enable the Hall element 17 to generate a pulse of adequate strength and duration. For example the flux density of a typical primary magnet, at its pole face, may be 1500 – 2000 gauss. A finger 26 of a typical rotor 22 is quite unlikely to be able to shield the element 17 entirely from such a strong flux density. Instead, the Hall element usually will be subjected to some residual flux thereby reducing the flux differential between the times that the Hall element is exposed to and shielded from the flux. The reduction in flux differential is disadvantageous because it not only affects the amplitude of the generated pulse, but also the timing between energization and deenergization of the pulse generator.

In the disclosed construction the advantages due to the relatively strong primary magnet are retained without adversely affecting the flux differential. This result is achieved by means of the bias magnet 20 which, as has been stated hereinbefore, has a polarity opposing the polarity of the primary magnet 5. The opposing polarities of the two magnets, coupled with their being positioned on opposite sides of the Hall element 17, enables the effects of the residual flux to which the Hall element 17 is subjected largely to be dissipated. At the same time, however, the magnetic field of the magnet 20 has little effect on the magnetic field of the primary magnet 5 when the Hall element 17 is unshielded, because of the high magnetic strength of the primary magnet. As a consequence, pulses generated by the Hall element have adequate amplitude and the flux differential between the times that the Hall element is shielded and unshielded by the fingers 26 is sufficiently great to obtain uniform timing between energization and deenergization of the Hall element.

The strength of the primary magnet is inversely proportional to the spacing between adjacent fingers 26. The relative strengths of the primary and bias magnets are selected with consideration being given to a number of factors, such as the width of the gap 18, the width of the slot 25 between adjacent fingers 26, and whether the gap 18 is the only air gap in the magnet circuit or whether an additional gap exists in the flux path. For a given set of circumstances involving such factors the relative strengths of the magnets can be determined empirically. In a typical installation employing the construction like that disclosed in the drawing wherein the width of the gap 18 is about 0.1 inch and the width of each slot 25 is about 0.2 inch excellent results may be obtained if the primary magnet 5 has a flux density at its face 6 of about 2000 gauss and is about ten times the flux density at the face of the bias magnet 20 which confronts the Hall element 17, the flux densities of the magnets being measured when both are in the magnetic circuit.

As has been mentioned previously, and Hall Effect element almost invariably will have electrical characteristics somewhat different from another. Thus, the relative strengths of the primary and bias magnets may require adjustment if pulses generated by different Hall elements are to be optimized. Such adjustment can be effected in either one or two ways. For example, a bias magnet associated with a given Hall element may be replaced by another having either a greater or lesser magnetic strength. Whether the magnetic strength should be increased or decreased may be determined from an examination of pulses generated by such Hall element. Alternatively, the magnetic strength of the bias magnet may be varied by increasing or decreasing its magnetic strength by known magnetizing and demagnetizing techniques. In either case, the adjustment is quite simple and may be effected at an inspection station during manufacture of the apparatus.

The disclosed embodiment is representative of a presently preferred form of the invention, but is intended to be illustrative rather than definitive thereof. The invention is defined in the claims.

I claim:

1. Magnetic circuit apparatus for an electronic ignition system of a combustion engine comprising magnetically permeable frame means; first magnet means carried by said frame means for establishing with the latter a magnetic flux path; second magnet means carried by said frame means in confronting relation with but spaced from said first magnet means; and pulse generating means interposed between said first and second magnet means in said flux path and spaced from said first magnet means by a gap of sufficient width to enable magnetically permeable means to pass between said pulse generating means and said first magnet means, said pulse generating means being responsive to changes in the density of the magnetic flux to which it is subjected to generate an electrical pulse.

2. Apparatus according to claim 1 wherein said first magnet means comprises a permanent magnet.

3. Apparatus according to claim 1 wherein said second magnet means comprises a permanent magnet.

4. Apparatus according to claim 1 wherein said frame means comprises a one-piece, U-shaped member.

5. Apparatus according to claim 4 wherein said frame forms an uninterrupted flux path between said first and second magnet means.

6. Apparatus according to claim 1 wherein the polarity of said first magnet means opposes the polarity of said second magnet means.

7. Apparatus according to claim 1 wherein the magnetic flux density of said first magnet means exceeds that of said second magnet means.

8. Apparatus according to claim 7 wherein said first magnet means has a magnetic flux density about 10 times that of said second magnet means.

9. Apparatus according to claim 7 wherein said first magnet means and said second magnet means have confronting pole faces of substantially uniform area.

10. Apparatus according to claim 9 wherein said first magnet means has a body tapering toward its pole face.

11. Magnetic circuit apparatus for an electronic ignition system of a combustion engine, said system including a movable member having a plurality of spaced apart, magnetically permeable fingers, said apparatus comprising a frame composed of magnetically permeable material; field magnet means carried by said frame for establishing with the latter a flux path, said field magnet means having a flux density inversely proportional to the spacing between said fingers; pulse generating means carried by said frame in said flux path and spaced from said field magnet means by a gap of sufficient width to enable said fingers to pass successively between said pulse generating means and said field magnet means and thereby change the magnetic density of the flux to which said pulse generating means is subjected, said pulse generating means being responsive to changes in the density of said flux to generate an electrical pulse; and bias magnet means carried by said frame, said bias magnet means confronting said field magnet means with said pulse generating means interposed between said field and said bias magnetic means.

12. Apparatus according to claim 11 wherein the polarity of said bias magnet means is opposite the polarity of said field magnet means.

13. Apparatus according to claim 12 wherein said field magnet means has a flux density exceeding that of said bias magnet means.

14. Apparatus according to claim 13 wherein said field magnet means has a flux density of about 10 times that of said bias magnet means.

15. Apparatus according to claim 11 wherein said frame comprises a one-piece, U-shaped member.

* * * * *